US008500465B1

(12) United States Patent
Ross et al.

(10) Patent No.: US 8,500,465 B1
(45) Date of Patent: Aug. 6, 2013

(54) ADAPTIVE CABLE CONNECTION SYSTEM

(75) Inventors: Peter G. Ross, Olympia, WA (US); Kelsey M. Wildstone, Seattle, WA (US); Richard Arvel Stevens, Auburn, WA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 13/234,067

(22) Filed: Sep. 15, 2011

(51) Int. Cl.
*H01R 9/00* (2006.01)

(52) U.S. Cl.
USPC ..... 439/79

(58) Field of Classification Search
USPC ..... 439/79
See application file for complete search history.

(56) References Cited

U.S. PATENT DOCUMENTS

| | | | | |
|---|---|---|---|---|
| 4,361,372 | A | 11/1982 | Majkrzak et al. | |
| 6,863,546 | B2 * | 3/2005 | Yang et al. | 439/79 |
| 7,031,171 | B2 | 4/2006 | Marcotte et al. | |
| 7,037,142 | B2 * | 5/2006 | Evans | 439/680 |
| 7,374,436 | B2 * | 5/2008 | Schell et al. | 439/79 |
| 2003/0129865 | A1 * | 7/2003 | Kato et al. | 439/79 |
| 2005/0041952 | A1 * | 2/2005 | Ko | 386/46 |
| 2006/0105597 | A1 * | 5/2006 | Purwin | 439/79 |
| 2010/0169531 | A1 * | 7/2010 | Bae | 710/303 |

* cited by examiner

*Primary Examiner* — Gary F. Paumen
(74) *Attorney, Agent, or Firm* — Robert C. Kowert; Meyertons, Hood, Kivlin, Kowert & Goetzel, P.C.

(57) ABSTRACT

A system includes electrical components, a chassis assembly that encloses the electrical components, one or more chassis connectors coupled to the chassis assembly, and two or more cable connection panels. The cable connection panels interchangeably couple with the chassis assembly. The cable connection panels hold one or more cables relative to the chassis assembly such that the conductors of the cables can electrically couple to the chassis connectors. At least two of the cable connection panels can couple a cable having a different end configuration than at least one other of the cable connection panels.

24 Claims, 6 Drawing Sheets

ADAPTIVE CABLE CONNECTION SYSTEM

BACKGROUND

Organizations such as on-line retailers, Internet service providers, search providers, financial institutions, universities, and other computing-intensive organizations often conduct computer operations from large scale computing facilities. Such computing facilities house and accommodate a large amount of server, network, and computer equipment to process, store, and exchange data as needed to carry out an organization's operations. Typically, a computer room of a computing facility includes many server racks. Each server rack, in turn, includes many servers and associated computer equipment.

Because the computer room of a computing facility may contain a large number of servers, a large amount of electrical power may be required to operate the facility. In addition, the electrical power is distributed to a large number of locations spread throughout the computer room (e.g., many racks spaced from one another, and many servers in each rack). Usually, a facility receives a power feed at a relatively high voltage. This power feed is stepped down to a lower voltage (e.g., 110V). A network of cabling, bus bars, power connectors, and power distribution units, is used to deliver the power at the lower voltage to numerous specific components in the facility.

Primary power systems for computer systems in operation typically need to be maintained or reconfigured from time to time. Some data centers, for example, have "single threaded" distribution via the electrical power supply to the floor and/or to the rack, and in which maintenance can only be performed when the components using power in the data center, such as servers, are shut-off. The down-time associated with maintenance and reconfiguration of primary power systems in a data center may result in a significant loss in computing resources. In some critical systems such as hospital equipment and security systems, down-time may result in significant disruption and, in some cases, adversely affect health and safety. In some systems, an automatic transfer switch provides switching between alternate power systems. For example, an automatic transfer switch may switch power between a primary power system and a back-up power system.

Cabling provisions for a particular systems or components may vary from data center to data center. For example, cabling for automatic transfer switches in one data center may include connector plugs, while cabling for automatic transfer switches in another data center may include a power whip with individual wires that must be separately attached to terminals on the automatic transfer switches. In some cases, even within a particular data center, cabling provisions may differ for a particular type of component from one location to another within the data center. The different cable provisions for these components may require the data center operator to stock and support multiple interface configurations for a particular component in order to accommodate the different cable configurations. Stocking multiple interface configurations of a component may increase the overall cost of the components to a data center operator, as well as making maintenance and inventory management more complex and difficult.

Figure 1:
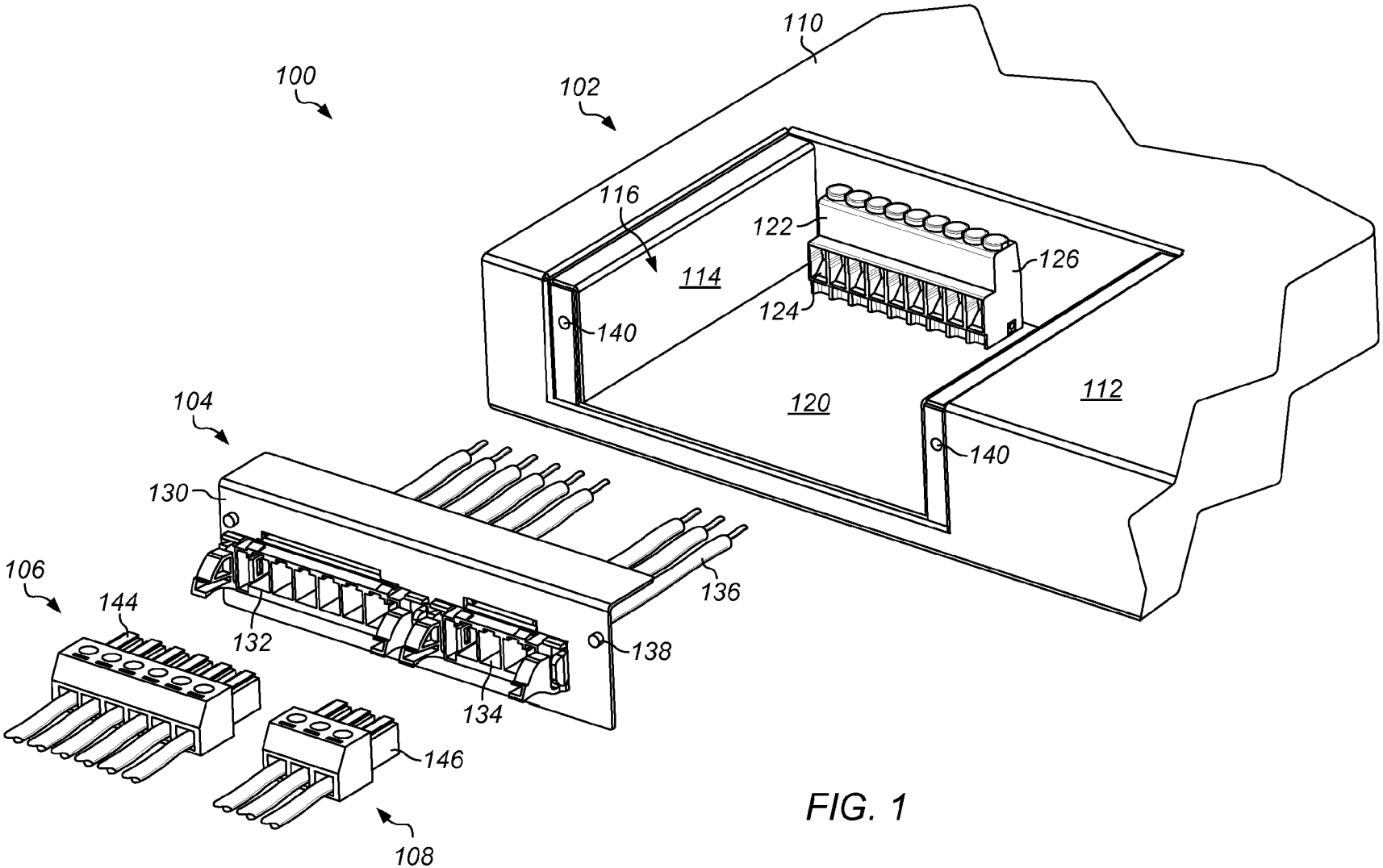
FIG. 1 is an exploded view illustrating one embodiment of a system for making an electrical connection using a cable connection panel.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

Various embodiments of methods and systems for providing power to electrical systems, such as computing devices in a data center, are disclosed. According to one embodiment, a system includes electrical components, a chassis assembly that encloses the electrical components, one or more chassis connectors coupled to the chassis assembly, and two or more cable connection panels. The cable connection panels interchangeably couple with the chassis assembly. The cable connection panels hold one or more cables relative to the chassis assembly such that the conductors of the cables can electrically couple to the chassis connectors. At least two of the cable connection panels can couple a cable having a different end configuration than at least one other of the cable connection panels.

According to one embodiment, a system for providing electrical connections to an electrical system includes a chassis assembly that enclose two or more electrical components, one or more chassis connectors coupled to the chassis assembly, and one or more cable connection panels that removably couple with the chassis assembly. The cable connection panels hold one or more cables such that the conductors of the cables can electrically couple to the one or more chassis connectors.

According to one embodiment, an automatic transfer switch system includes electrical components, a chassis assembly coupled to the electrical components, and one or more chassis connectors that couple to the chassis assembly and electrically couple with conductors of one or more cables external to the chassis assembly. The electrical components automatically switch power between a first power input and a second power input. The chassis assembly couples with a removable cable connection panel such that the cable connection panel holds at least one of the one or more cables such that the conductors of the cables can electrically couple to the chassis connectors when the cable connection panel is coupled to the chassis assembly.

According to one embodiment, a method of providing power to electrical systems includes selecting, from among two or more cable connection panels, a cable connection panel to be installed on a chassis assembly for an electrical system. At least two of the cable connection panels from which the panel is selected couple an external cable having a different end configuration than at least one other of the cable connection panels to a chassis connector. The selected cable connection panel is coupled to the chassis assembly. The external cables are supported by the cable connection panel.

As used herein, "cable connection panel" means any element or combination of elements on which a cable, connector, or cable guide can be held in relation to a chassis or rack. Examples of cable connection panels may include a plate, bar, bracket, block, brace, frame, holder, or member, or any combination thereof. A panel may have any regular or irregular shape. A panel may be flat, convex, concave, or combination thereof. In some embodiments, a panel includes a molded base for holding a connector receptacle or cable guides.

As used herein, "chassis connector" means an electrical connector that is coupled in a fixed relationship relative to a chassis. A chassis connector may be directly or indirectly coupled to the chassis. For example, a chassis connector may be mounted on a circuit board assembly that is carried by a chassis.

As used herein, a "terminal block" is a component, device, or combination thereof that includes one or more terminals to which individual conductive elements, such as wires, can be attached.

As used herein, a "electrical connector" is a component, device, or combination thereof that provides a electrical connection between two or more conductive elements. Examples of electrical connectors include electrical plugs, electrical receptacles, terminal blocks, and combinations thereof.

As used herein, "computer room" means a room of a building in which computer systems, such as rack-mounted servers, are operated.

As used herein, "data center" includes any facility or portion of a facility in which computer operations are carried out. A data center may include servers dedicated to specific functions or serving multiple functions. Examples of computer operations include information processing, communications, simulations, and operational control.

As used herein, a "cable" includes any cable, conduit, or line that carries one or more conductors and that is flexible over at least a portion of its length. A cable may include a connector portion, such as a plug, at one or more of its ends.

As used herein, "power distribution unit" means any device, module, component, or combinations thereof, which can be used to distribute electrical power. The elements of a power distribution unit may be embodied within a single component or assembly (such as a transformer and a rack power distribution unit housed in a common enclosure), or may be distributed among two or more components or assemblies (such as a transformer and a rack power distribution unit each housed in separate enclosure, and associated cables, etc.). A power distribution unit may include a transformer, power monitoring, fault detection, and isolation.

As used herein, "floor power distribution unit" refers to a power distribution unit that can distribute electrical power to various components in a computer room. A power distribution unit may be housed in an enclosure, such as a cabinet.

As used herein, "rack power distribution unit" refers to a power distribution unit that can be used to distribute electrical power to various components in a rack. A rack power distribution may include various components and elements, including wiring, bus bars, connectors, and circuit breakers. In some embodiments, a rack power distribution unit may distribute power to only some of the electrical systems in a rack. In some embodiments, a single rack includes two or more rack power distribution units that distribute power to different sets of electrical systems in the rack. For example, one rack may include a left rack power distribution unit that distributes power to half of the servers in the rack, and a right rack power distribution unit that distributes power to the other half of the servers in the rack.

As used herein, a "module" is a component or a combination of components physically coupled to one another. A module may include functional elements and systems, such as computer systems, circuit boards, racks, blowers, ducts, and power distribution units, as well as structural elements, such a base, frame, housing, or container.

As used herein, "primary power" means any power that can be supplied to an electrical load, for example, during normal operating conditions.

As used herein, "reserve power" means power that can be supplied to an electrical load upon the failure of, or as a substitute for, primary power to the load.

As used herein, "circuit board" means any board or plate that has one or more electrical conductors transmitting power, data, or signals from components on or coupled to the circuit board to other components on the board or to external components. In certain embodiments, a circuit board is an epoxy glass board with one or more conductive layers therein. A circuit board may, however, be made of any suitable combination of materials.

As used herein, "chassis" means a structure or element that supports another element or to which other elements can be mounted. A chassis may have any shape or construction, including a frame, a sheet, a plate, a box, a channel, or a combination thereof. In one embodiment, a chassis is made from one or more sheet metal parts. A chassis for a computer system may support circuit board assemblies, power supply units, data storage devices, fans, cables, and other components of the computer system.

As used herein, "computing" includes any operations that can be performed by a computer, such as computation, data storage, data retrieval, or communications.

As used herein, "computing device" includes any of various devices in which computing operations can be carried out, such as computer systems or components thereof. One example of a computing device is a rack-mounted server. As used herein, the term computing device is not limited to just those integrated circuits referred to in the art as a computer, but broadly refers to a processor, a server, a microcontroller, a microcomputer, a programmable logic controller (PLC), an application specific integrated circuit, and other programmable circuits, and these terms are used interchangeably herein. Some examples of computing devices include e-commerce servers, network devices, telecommunications equipment, medical equipment, electrical power management and control devices, and professional audio equipment (digital, analog, or combinations thereof). In various embodiments, memory may include, but is not limited to, a computer-readable medium, such as a random access memory (RAM). Alternatively, a compact disc—read only memory (CD-ROM), a magneto-optical disk (MOD), and/or a digital versatile disc (DVD) may also be used. Also, additional input channels may include computer peripherals associated with an operator interface such as a mouse and a keyboard. Alternatively, other computer peripherals may also be used that may include, for example, a scanner. Furthermore, in the some embodiments, additional output channels may include an operator interface monitor and/or a printer.

As used herein, "member" includes a single element or a combination of two or more elements (for example, a member can include two or more sheet metal parts fastened to one another).

In some embodiments, a system for providing electrical connections to an electrical system, such as an automatic transfer switch, includes a removable cable connection panel. The cable connection panel may hold one or more cables in position relative to the connector on a chassis of the electrical system.

FIG. 1 is an exploded view illustrating one embodiment of a system for making an electrical connection using a cable connection panel. System 100 includes electrical system 102, cable connection panel 104, input power cable 106, and output power cable 108. Electrical system 102 includes chassis assembly 110. Chassis assembly 110 includes chassis body 112 and recess panels 114. Chassis body 112 and recess panels 114 cooperate to form recess pocket 116.

Electrical system 102 includes printed circuit board 120. Chassis connector 122 is mounted on printed circuit board 120. Printed circuit board 120 is coupled to, and supported by, chassis assembly 110. Chassis connector 122 includes terminals 124. Terminals 124 are carried on terminal block body 126.

Terminals 124 may be electrically coupled to traces or other conductive elements of electrical system 102. Electrical power received through chassis connector input power cable 106, and output power cable 108 may be coupled with electrical components of electrical system 102 by way of traces on printed circuit board 120 and/or other printed circuit boards in chassis assembly 110.

In the embodiment shown in FIG. 1, chassis connector 122 is a terminal block. In various embodiments, however, chassis connector 122 may be any type of connector. In certain embodiments, a chassis connector provides a pin/socket connection between the end of an external cable and conductive elements of the electrical system.

Cable connection panel 104 includes base plate 130, input connector receptacle 132, output connector receptacle 134, wires 136, and fasteners 138. Input connector receptacle 132 and output connector receptacle 134 are mounted in base plate 130. One of wires 136 is connected to each contact in input connector receptacle 132 and output connector receptacle 134.

Cable connection panel 104 may be attached to chassis assembly 110 by various fastener arrangements. In one embodiment, cable connection panel 104 is installed by way of fasteners installed in threaded holes 140 in chassis assembly 110. Examples of other mounting systems include clips, cams, quarter-turn fasteners, rails, slots, or hooks.

Input power cable 106 includes input cable power plug 144. Output power cable 108 includes output cable power plug 146. Input power plug 144 may be installed in input connector receptacle 132. Output power plug 146 may be installed in output connector receptacle 134.

In some embodiments, electrical system 102 is an automatic transfer switch. The automatic transfer switch may switch power among two more inputs to one power output. For example, three of the contacts in input power cable 106 may supply power from a first power feed to electrical system 102, and the other three contacts of input power cable 106 may carry power for a second power feed to electrical system 102. Output power cable 108 may carry power from electrical system 102 to electrical loads, such as servers in a rack. Electrical system 102 may automatically switch output power between the first power feed and the second power feed.

In one embodiment, three lines for a power feed may be the three phase lines (A, B, and C) of a three phase power system. In another embodiment, three lines for a power feed include two hot phase lines and one neutral.

Although in the embodiment described above relative to FIG. 1, each power feed includes three conductors, a power feed may, in various embodiments, include any number of conductors. In one embodiment, a power feed includes one hot conductor and one neutral conductor.

Although in the embodiment described above, the cable connection panel is described as carrying power, a cable connection panel may carry power, signals, data or combinations thereof.

Figure 2:
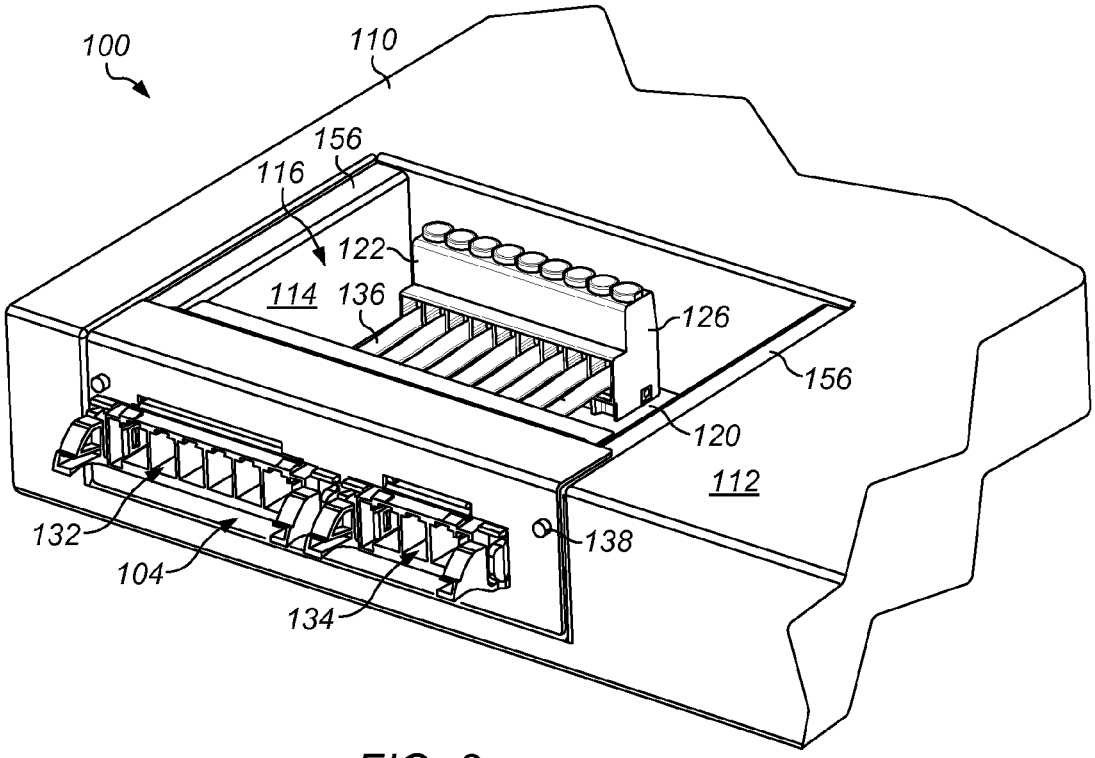
FIG. 2 illustrates one embodiment of a cable connection panel with connector receptacles installed on a chassis for an electrical system.

FIG. 2 illustrates one embodiment of a cable connection panel with connector receptacles installed on a chassis for an electrical system. Cable connection panel 104 may be installed on chassis assembly 110. Fasteners 138 may secure cable connection panel 104 to chassis assembly 110.

Each of wires 136 may be coupled to one of terminals 124 of chassis connector 122. In one embodiment, wires 136 carry power from two or more feeds into electrical system 102 and carry power out of electrical system 102 to electrical loads, such as computing devices.

As illustrated in the example shown in FIG. 2, chassis connector 122 is located behind the front face of chassis assembly 112. A portion of cable connection panel 104 is behind the front face of chassis assembly 112.

Figure 3:
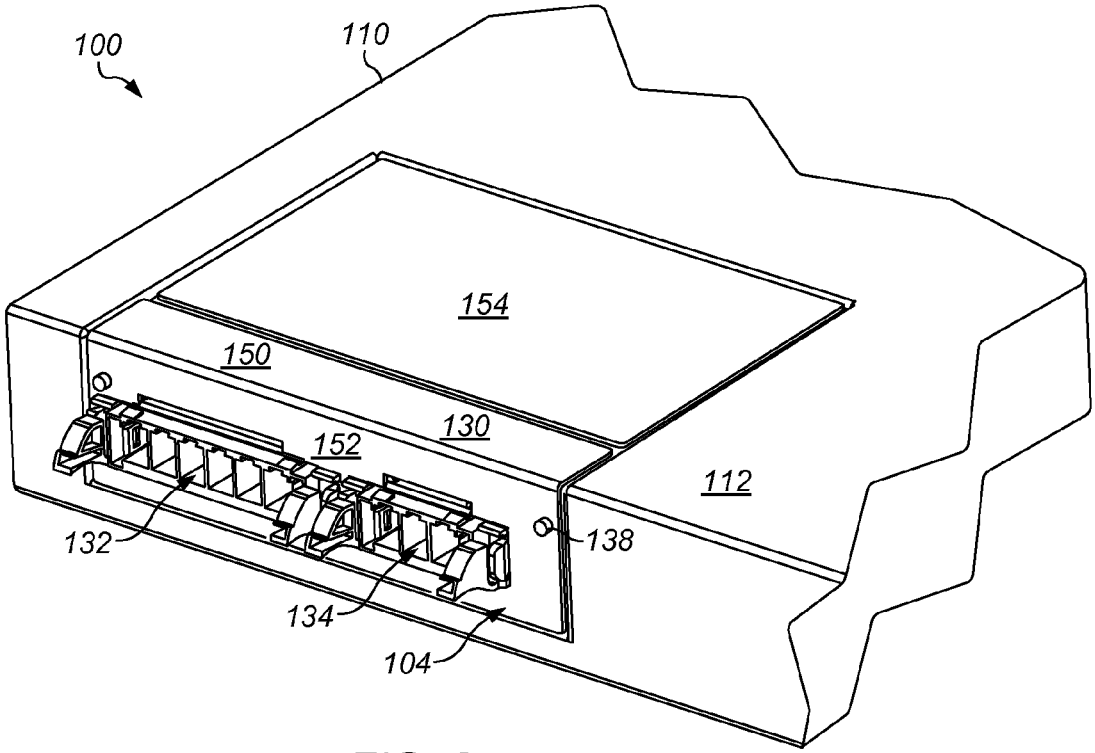
FIG. 3 illustrates one embodiment of a system including a cable connection panel and a cover for a connector cavity behind the cable connection panel.

FIG. 3 illustrates one embodiment of a system including a cable connection panel and a cover for a connector cavity behind the cable connection panel. Cable connection panel 104 includes face panel 152 and upper rim 150. Upper rim 150 extends rearward from face panel 152.

System 100 includes recess cover 154. Recess cover 154 may enclose a recess pocket in chassis assembly 112 (recess pocket may be as shown, for example, as recess pocket 116 in FIG. 2).

Recess cover 154 may be coupled to chassis assembly 110, cable connection panel 104, or both. Recess cover 154 may be secured in any manner, such as by screws, clips, cams, quarter-turn fasteners, rails, slots, or hooks.

Figure 4:
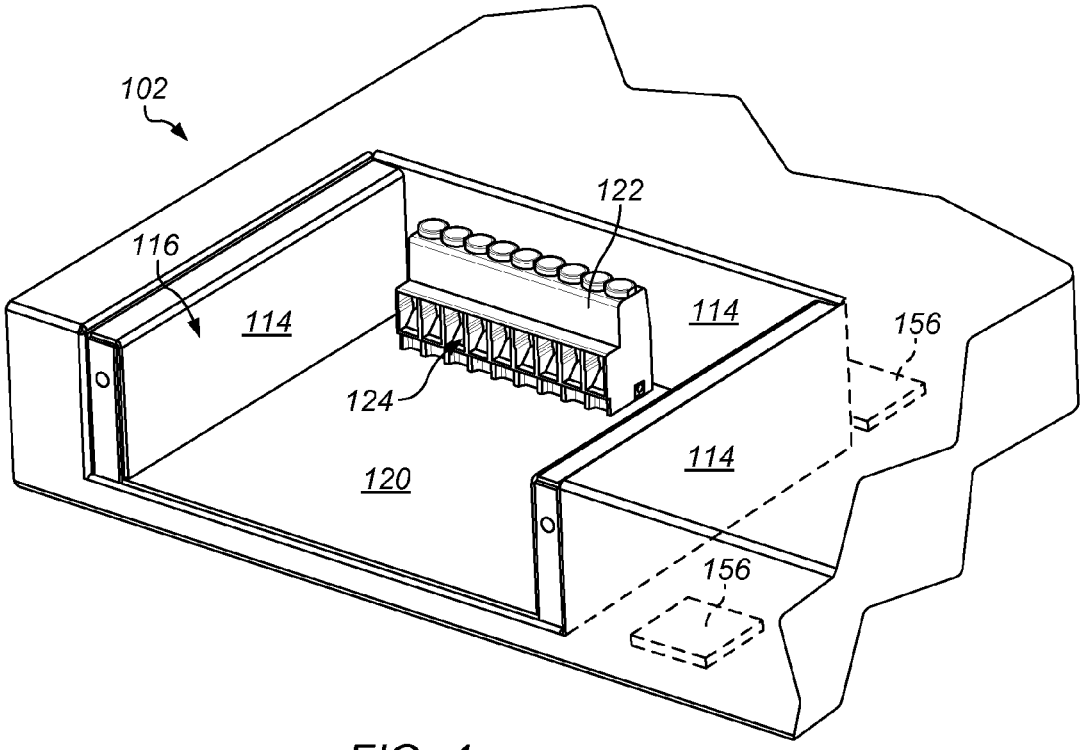
FIG. 4 illustrates one embodiment of an electrical system including a terminal block mounted in a recess in a chassis.

In some embodiments, a chassis connector includes a terminal block mounted on a printed circuit board. FIG. 4 illustrates one embodiment of an electrical system including terminal block mounted in a recess in a chassis. Chassis connector 122 is mounted on printed circuit board 120. Terminals 124 of chassis connector 122 may be arranged to allow termination of cable conductors in recess pocket 116.

In some embodiments, elements of a chassis assembly inhibit inadvertent contact with electrical components while connections are made between an external cable and a chassis connector. For example, recess panels 114 may block a user's finger or installation tool from contacting components of the electrical system, such as semiconductor components 156 mounted on printed circuit board 120. In some embodiments, protection of components by a chassis assembly meets a standard, such as a NEMA or IEC 60529 standard. In one embodiment, a chassis assembly provides protection for power connection operations at an Ingress Protection rating of IP20, finger safe. In certain embodiment, a chassis recess for a power connector is the only user-serviceable area for an electrical system.

In one embodiment, recess panels 114 on either side of recess pocket 116 are formed of sheet metal. The sheet metal may be folded to form a shelf for a recess cover to rest on.

In the embodiments shown in FIG. 4, recess panels 114, chassis base 112, and recess cover 154 are shown as solid panels. Protective elements of a chassis or panels may, however, have any construction. Examples of protective elements include a screen, a grille, or a mesh.

In the embodiment shown in FIG. 4, recess pocket 116 has forms a generally rectangular volume. A recess behind a cable connection panel may, however, have in various embodiments any shape and size. For example, a recess may be tubular, ovate, or irregular in shape.

In some embodiments, a connector arrangement on a cable connection panel inhibits incorrect installation of cables in a system. For example, a cable connection panel may inhibit cross-connecting of input power and output power cables. In the embodiment shown in FIG. 1, for example, input cable power plug 144 physically cannot be plugged into output connector receptacle 134 on cable connection panel 104, and output cable power plug 146 physically cannot be plugged into input connector receptacle 132 on cable connection panel 104.

In some embodiments, a cable connection panel is arranged to inhibit cross connecting of two different inputs (for example, a primary power input and a secondary power input). For example, as shown in FIG. 1, the two power feeds carried in input cable power plug 144 cannot be reversed because input cable power plug 144 can only be installed in input connector receptacle 132 in one orientation.

In certain embodiments, a cable connection panel includes a visual indication of status, such as whether power is being supplied to an electrical system. For example, cable connection panel 104 may include light emitting diode indicators that show when a particular pair of lines is receiving power through the external cable.

In some embodiments, a system includes two or more interchangeable cable connection panels for a chassis-mounted electrical system. Each of the cable connection panels can electrically couple an external cable having a different end configuration to the chassis connector. For example, a first cable connection panel may be used to connect an external cable having a particular type of connector plug, while a second cable connection panel may be used to couple a power whip terminating in a set of wire strands. Different cable connection panels may be used to adapt the different cable configuration with the electrical system.

Figure 5:
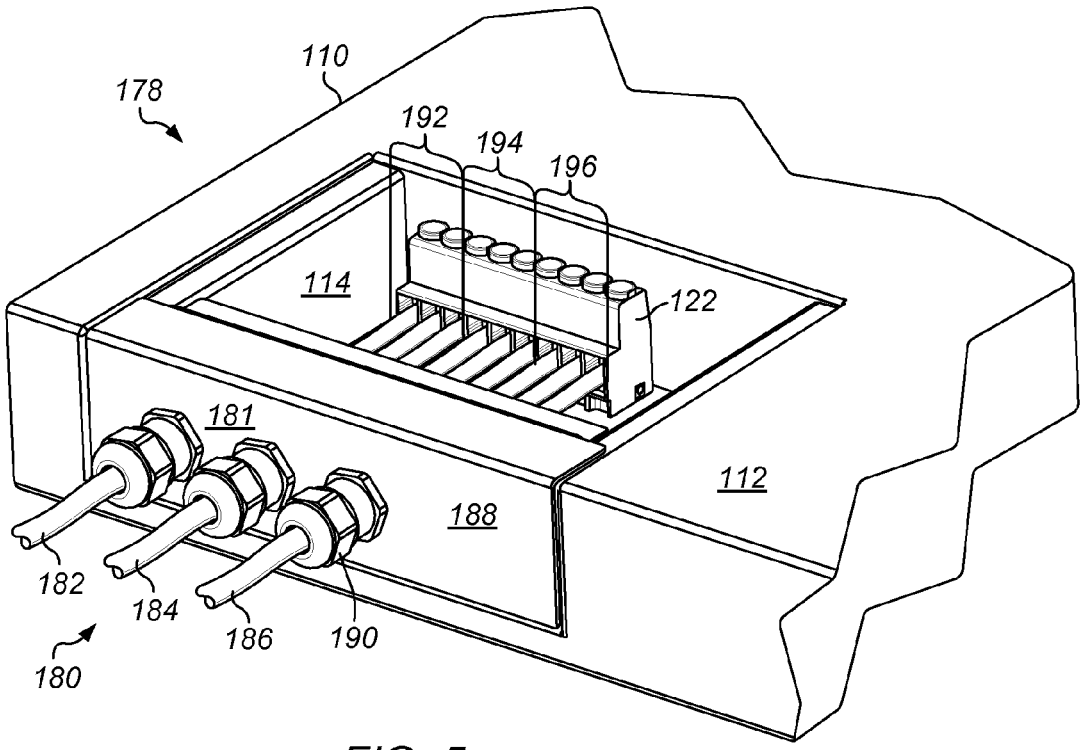
FIG. 5 illustrates one embodiment of a power connection panel including cable feed-throughs for a set of power whips.

FIG. 5 illustrates one embodiment of a power connection panel including cable feed-throughs for a set of power whips. System 178 includes electrical system 104, power whips 180, and cable connection panel 188. Power whips 180 include cables 182, 184, and 186.

Cable connection panel 104 includes base plate 181 and cable guides 190. In one embodiment, cables guides 190 are stuffing glands. Cable guides 190 may provide strain relief for cables 182, 184, and 186 as cables pass through cable guides 190. Cables 182, 184, and 186 may each carry multiple conductors in a common sheath. After passing through cable guides 190, cables 182, 184, and 186 separate into individual wires. Cable 182 separates into conductors 192. Cable 184 separates into conductors 194. Cable 186 separates into conductors 196. Conductors 192, 194, and 196 may be coupled to terminals 124 of chassis connector 122.

Figure 6:
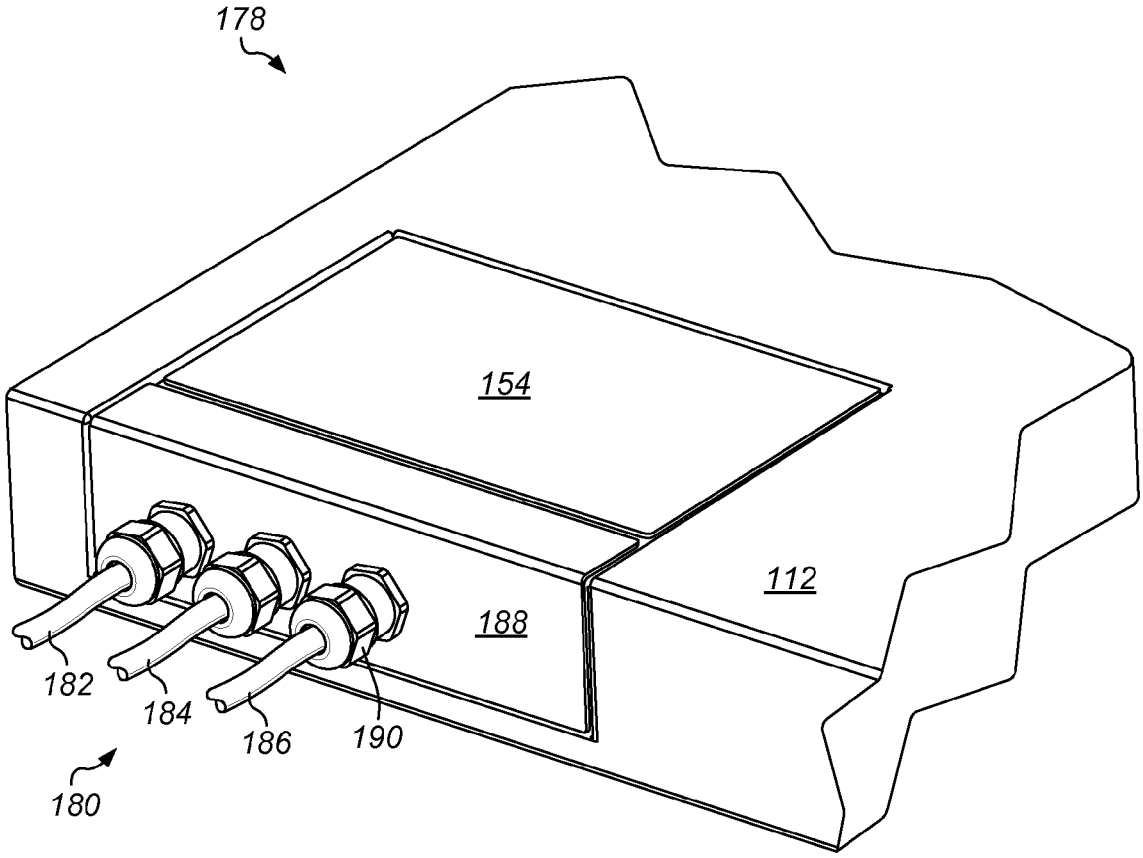
FIG. 6 illustrates one embodiment of a system with a power connection panel having cable feed-throughs and a recess cover.

FIG. 6 illustrates one embodiment of a system with a power connection panel having cable feed-throughs and a recess cover. Recess cover 154 may provide protection against inadvertent contact with conductors in recess pocket 116.

In some embodiments, a system includes two or more interchangeable cable connection panels for an electrical system. Each of the cable connection panels may connect a different end cable configuration to the electrical system. For example, if electrical system 102 is to be used at a location in which external input cable 106 and external output cable 108 (shown in FIG. 1) are provided, cable connection panel 104 may be installed on electrical system 102. If electrical system 102 is to be used at a location in which power whips are provided, cable connection panel 188 (shown in FIG. 5) may be installed on electrical system 102.

Figure 7:
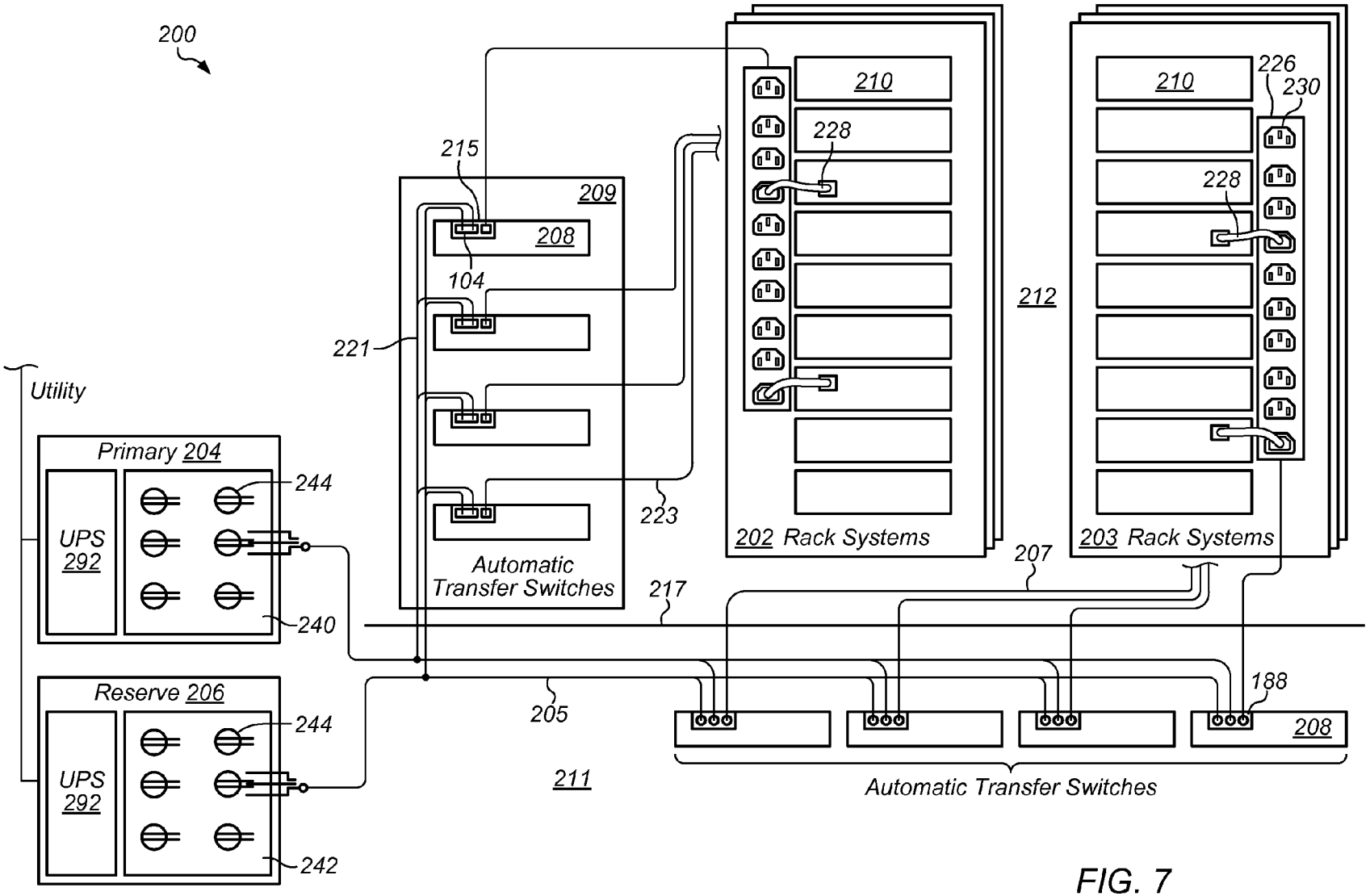
FIG. 7 illustrates an embodiment of a data center including a single type of automatic transfer switch that is connected to different cable connections within the data center.

In some embodiments, a data center includes two or more different connection configurations for a particular type of electrical system. FIG. 7 illustrates an embodiment of a data center including a single type of automatic transfer switch (for example, a single SKU) that is connected to different types of cable connection within the data center, depending on the locations of the automatic in the data center.

Data center 200 includes rack systems 202, rack systems 203, primary power system 204, reserve power system 206, and automatic transfer switches 208. Rack systems 202 and rack systems 203 include electrical systems 210. Electrical systems may include, for example, computer systems, rack-mounted servers, network control devices, power supply units, air moving devices, and mass storage devices.

Rack systems 202 and rack systems 203 are located in computing room 212. Electrical systems 210 may receive electrical power from primary power system 204 and reserve power system 206 by way of subfloor feed to computing room 212. Primary power system 204 and reserve power system 206 are coupled to automatic transfer switches 208 in ATS rack 209 and subfloor location 211. Automatic transfer switches 208 in ATS rack 209 switch between primary and reserve input power and supply the power to electrical systems 210 in rack systems 202. Automatic transfer switches 208 in subfloor location 211 switch between primary and reserve input power and supply the power to electrical systems 210 in rack systems 203. Rack power distribution units 226 in rack systems 203 may be coupled to automatic transfer switch 208 through floor 217.

The cabling systems that carry power to and from automatic transfer switches 208 may differ from location to location in data center 200. For example, in ATS rack 209, input power cables 221 and output power cables 223 may terminate in connector plugs, such as described above relative to FIGS. 1-4. In subfloor location 211, input power cables 205 and output power cables 207 may include power whips terminating in wire strands, such as described above relative to FIGS. 5 and 6. In various embodiments, different cable connection panels may be used in different locations to adapt a common model of automatic transfer switch to a different a cable end configuration. For example, in ATS rack 209, a cable connection panel with a connector receptacle (such as cable connection panel 104 shown in FIG. 1) may be used to connect input power cables 221 and output power cables 223 to automatic transfer switch 208. In subfloor location 211, a cable connection panel with cable guides (such as cable connection panel 188 shown in FIG. 5) may be used to support input power cables 205 and output power cables 207 when the wire conductors are terminated on automatic transfer switch 208. Thus, in this embodiment, a common part number (for example, SKU) may be used for the automatic transfer switch in different locations of the data center, regardless of the power cable provisioning to the location.

Rack power distribution unit 226 includes rack PDU receptacles 130. In one embodiment, rack PDU receptacles 230 are IEC 60320 C13 receptacles. In one embodiment, rack PDU receptacles 230 are IEC 60320 C19 receptacles. In some embodiments, all of rack PDU receptacles 230 are wired in parallel with one another. In other embodiments, rack PDU receptacles 230 may be split into two or more banks of receptacles. The receptacles in each bank may be wired in parallel with one another. In some embodiments, one bank of receptacles is provided for each hot wire from the power source (one bank for A-neutral, another for B-neutral) or for each hot wire pairing from the power source (AB, BC, AC).

In operation of data center 200, any or all of rack PDU receptacles 230 may be used to supply power to electrical systems in rack system 102, such as servers. Electrical systems 210 are coupled to rack power distribution unit 226 by way of cables 228. Cables 228 are coupled in various rack PDU receptacles 230.

Primary power system 204 includes primary source receptacle panel 240. Reserve power system 206 includes reserve source receptacle panel 242. Each of primary source receptacle panel 240 and reserve source receptacle panel 242 includes source power receptacles 244. Automatic transfer switches 208 may be coupled to an appropriate one of receptacles 244 in primary source receptacle panel 240. Automatic transfer switches 208 may be coupled to an appropriate one of receptacles 244 in reserve source power panel 242.

Primary power system 204 and reserve power system 206 may include one or more of various other components and sub-systems, such as transformers, generators, switchgear, and floor power distribution units. Primary power system 204 and reserve power system 106 each include UPS 292. In some embodiments, primary source receptacle panel 240 and reserve source receptacle panel 242 are each included in, or receive power from, a floor power distribution unit.

In some embodiments, a transformer for each of the power systems is coupled to a utility feed. The utility feed may be a medium voltage feed. In certain embodiments, the utility feed is at a voltage of about 13.5 kilovolts or 12.8 kilovolts at a frequency of about 60 Hz. Generators may provide power to primary power system 204 in the event of a failure of utility power to the transformer. In one embodiment, one generator provides back-up power for each of two or more primary power systems. UPS 292 may provide uninterrupted power to rack-mounted electrical systems in the event of a power failure upstream from UPS 292. In certain embodiments, UPS 292 receives three-phase power from a transformer. UPS 292 may supply three-phase power to a floor power distribution unit.

In one embodiment, receptacles 244 are NEMA L6-30R type. Each of the various receptacles on a floor power distribution unit may carry two phase lines and one ground. For example, each of the six receptacles 244 may be one of the six phase combinations AB, BC, AC, BA, CB, or CA. In some embodiments, a floor distribution unit may have one receptacle for each of the six phase combinations. In some embodiments, a floor distribution unit may have two or more receptacles for each of the six phase combinations. In some embodiments, a floor power distribution may have outputs for only some of the phase combinations (for example, AB, BC, and AC only). In certain embodiments, a floor distribution unit may receive and/or distribute two-phase power. In certain embodiments, a floor distribution unit may receive and/or distribute a single phase (for example, hot, neutral, and ground).

Although only one primary power system 204 and one reserve power systems 206 are shown in FIG. 7, automatic transfer switches may in a data center may receive power from any number of primary and reserve power systems.

The number of primary power systems 204 may vary from embodiment to embodiment. In certain embodiments, the primary power side in a data center includes only one primary power system. In addition, the number of power distribution units, UPSs, switchgear apparatus may vary from embodiment to embodiment (and, within a given embodiment, from system to system). In some embodiments, primary power system 204 includes many floor power distribution units. As another example, a primary power system may have one UPS that can supply power to many floor power distribution units.

Components and sub-systems of primary power system 204 and reserve power system 206 may be provided in any suitable location. In one embodiment, primary source receptacle panel 240 and reserve source receptacle panel 242, and automatic transfer switches 208 are in a sub-floor space below the floor of a computing room of a data center.

In FIG. 7, for the sake of clarity, only one rack system 202 and one rack system 203 are illustrated. In various embodiments, however, a system may have any number of rack systems, automatic transfer switches, and other components and systems. In one embodiment, two automatic transfer switches are provided for each rack system. Each of the two automatic transfer switches may control power for half of the servers in a rack system.

Figure 8:
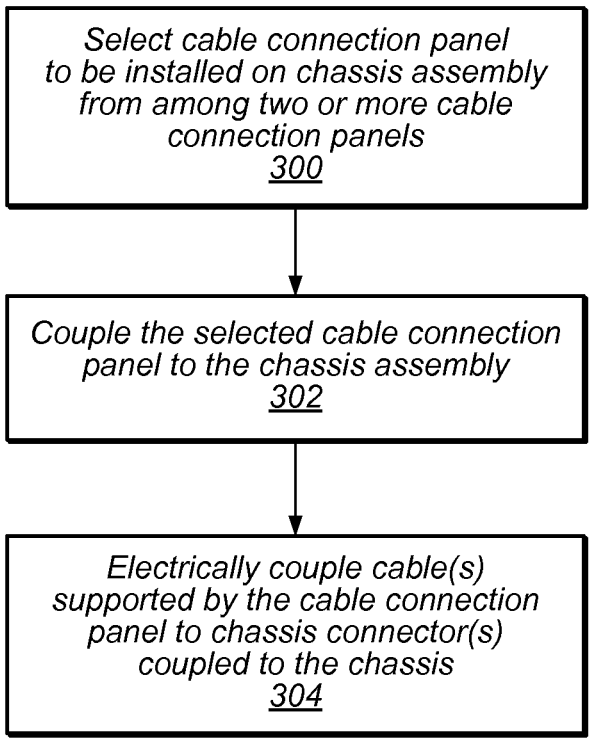
FIG. 8 illustrates one embodiment of providing power to electrical systems using electrical systems with interchangeable connection panels.

FIG. 8 illustrates one embodiment of providing power to electrical systems using electrical systems with interchangeable connection panels. The electrical systems may be, for example, automatic transfer switches that switch power to electrical loads between a primary power system and a reserve power system. At 300, a selection is made, from among two or more cable connection panels, for a cable connection panel to be installed on a chassis assembly for a particular electrical system. Each of the types of cable connection panels in the selection may support a different end configuration of a cable system for the electrical system. For example, one of the cable connection panels may include a connector receptacle (such as described above relative to FIG. 1), while another of the cable connection panels may include a feed-through for a power whip (such as described above relative to FIG. 5).

In some embodiments, the electrical system to which the cable connection panels are coupled is a common item regardless of the cable connection panel selected. The common electrical system may have one stock-keeping unit (SKU). Each of the cable connection panels may also have its own stock-keeping unit (SKU).

The cable connection panel selected for a particular electrical system may be based on the cable provisioning at the location for the electrical system. For example, one data center may have external cables with connector plugs such as shown in FIG. 1, while another data center may have external cables with power whips such as described above relative to FIG. 5. In some embodiments, a kit is provided for each different cable connection panel. The cable connection panel from the kit may be installed before or after shipping the electrical system to the site at which it is to be deployed.

At 302, the selected cable connection panel is coupled to the chassis assembly for the electrical system. The cable connection panel may support one or more external cables. In some embodiments, the cable connection panel is attached by way of fasteners, such as described above relative to FIG. 1.

At 304, one or more external cables are electrically coupled to a chassis connector on the electrical system. The external cables may be supported by the cable connection panel. Coupling the external cables to the chassis connector may, in one embodiment, include connecting wires from a cable connection panel to a terminal block coupled to the chassis assembly of the electrical system. In some embodiments, coupling the external cables includes plugging connector plugs of the external cables to connector receptacles in the cable connection panel.

In certain embodiments, an electrical system is reconfigured to include a different cable connection panel. The electrical system may be reconfigured, for example, if the electrical system is to be re-deployed in a location having different cable provisioning. For example, on electrical system 102, cable connection panel 104 described above relative to FIG. 1 can be removed and replaced by cable connection panel 188 described above relative to FIG. 5.

Various electrical connector elements, including terminal blocks, connector plugs, and connector receptacles may be of various types. In one embodiment, connector plugs, receptacles, and terminal blocks are produced by Phoenix Contact. In another embodiment, connector plugs, receptacles, and terminal blocks are produced by Amphenol Corporation. Examples of other connector elements that can be used in a system for connecting electrical systems to cabling include NEMA L6 series and IEC 60320 connector plugs and receptacles.

In various embodiments described above, conductors of a cable are connected to a chassis connector by way of wires. Conductors of a cable may, nevertheless, in some embodiments, be connected to an electrical system by other conductive elements, such as a rigid or semi rigid bars, rods, pins.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A system, comprising:

two or more electrical components;

a chassis assembly configured to at least partially enclose the two or more electrical components;

one or more chassis connectors coupled to the chassis assembly and configured to electrically couple with conductors of one or more cables external to the chassis assembly; and two or more cable connection panels, wherein each of at least two of the cable connection panels is configured to interchangeably couple with the chassis assembly;

wherein each of at least two of the cable connection panels is configurable to hold at least one of the one or more external cables relative to the chassis assembly such that the conductors of the cables are electrically coupleable to at least one of the chassis connectors, wherein each of at least two of the cable connection panels is configured to couple at least one cable having a different end configuration than at least one other of the cable connection panels, wherein at least a first one of the cable connection panels comprises a panel receptacle configured to receive a connector plug on at least one external cable, wherein at least a second one of the cable connection panels comprises a cable guide configured to pass through at least one external cable configured to couple with the at least one of the chassis connectors.

2. The system of claim 1, wherein the chassis assembly comprises a recess, wherein at least a portion of the at least one of the chassis connectors is in the recess in the chassis assembly.

3. The system of claim 1, wherein at least one of the chassis connectors is a terminal block.

4. The system of claim 1, wherein at least one of the chassis connectors is mounted on a circuit board coupled to the chassis assembly.

5. The system of claim 1, wherein the chassis assembly is configured to inhibit physical contact with electrical components by service personnel when the service personnel install or remove conductors from the one or more chassis connectors.

6. A system, comprising:

two or more electrical components;

a chassis assembly configured to at least partially enclose the two or more electrical components;

one or more chassis connectors coupled to the chassis assembly and configured to electrically couple with conductors of one or more cables external to the chassis assembly; and two or more cable connection panels, wherein each of at least two of the cable connection panels is configured to interchangeably couple with the chassis assembly;

wherein each of at least two of the cable connection panels is configurable to hold at least one of the one or more external cables relative to the chassis assembly such that the conductors of the cables are electrically coupleable to at least one of the chassis connectors, wherein each of at least two of the cable connection panels is configured to couple at least one cable having a different end configuration than at least one other of the cable connection panels, wherein the two or more electrical components comprise an automatic transfer switch, wherein at least one of the one or more chassis connectors feeds input power to the automatic transfer switch, and wherein at least one of the one or more chassis connectors feeds output power from the automatic transfer switch.

7. A system for providing electrical connections to an electrical system, comprising:

a chassis assembly configured to at least partially enclose two or more electrical components;

one or more chassis connectors coupled to the chassis assembly and configured to electrically couple with conductors of one or more cables external to the chassis assembly; and one or more cable connection panels configured to removably couple with the chassis assembly;

wherein each of at least one of the cable connection panels is configurable to hold at least one of the one or more cables such that the conductors of the cables are electrically coupleable to at least one of the one or more chassis connectors, wherein at least one of the cable connection panels comprises one or more panel receptacles, wherein the system further comprises one or more conductors configured to electrically couple one or more contacts of the panel receptacle to one or more contacts of at least one of the one or more chassis connectors.

8. The system of claim 7, wherein the chassis assembly comprises a recess, wherein at least a portion of at least one of the chassis connectors is in the recess in the chassis assembly.

9. The system of claim 8, wherein at least one of the cable connection panels is configured to at least partially enclose the recess of the chassis assembly when the cable connection panel is coupled to the chassis assembly.

10. The system of claim 8, wherein the chassis assembly is configured to inhibit service personnel from making physical contact with electrical components inside the chassis assembly when service personnel install or remove conductors from the one or more chassis connectors.

11. The system of claim 8, further comprising a cover coupled with the chassis, wherein the cover is configured to at least partially enclose at least a portion of the recess.

12. The system of claim 7, wherein at least one of the cable connection panels comprises one or more cable guides for at least one cable external to the chassis assembly.

13. The system of claim 7, wherein the one or more cable connection panels comprise two or more cable connection panels, wherein at least two of the cable connection panels are configured to interchangeably couple with the chassis assembly, wherein each of at least two of the cable connection panels is configured to couple with a cable having a different end configuration than at least one other of the cable connection panels.

14. The system of claim 7, wherein the chassis connector is configured to carry power to the electrical components.

15. An automatic transfer switch system, comprising:

two or more electrical components configured to automatically switch power between a first power input and a second power input;

a chassis assembly coupled to the two or more electrical components; and one or more chassis connectors coupled to the chassis assembly and configured to electrically couple with conductors of one or more cables external to the chassis assembly, wherein the chassis assembly is configured to couple with a removable cable connection panel such that the cable connection panel holds at least one of the one or more cables and such that the conductors of the cables are electrically coupleable to at least one of the one or more chassis connectors when the cable connection panel is coupled to the chassis assembly.

16. The automatic transfer switch system of claim 15, wherein at least one of the one or more chassis connectors is configurable to feed two or more power inputs into the automatic transfer switch, and wherein at least one of the one or more chassis connectors is configurable to feed one or more power outputs out of the automatic transfer switch.

17. The automatic transfer switch system of claim 15, wherein the cable connection panel comprises one or more panel receptacles, wherein at least one of the panel receptacles is configured to inhibit service personnel from incorrectly connecting power inputs or power outputs to the automatic transfer switch.

18. The automatic transfer switch system of claim 15, wherein the cable connection panel comprises one or more panel receptacles, wherein at least a first one of the panel receptacles is a power input receptacle, wherein at least a second one of the power input receptacles is a power output receptacle.

19. The automatic transfer switch system of claim 15, further comprising two or more cable connection panels configured to interchangeably couple with the chassis assembly, wherein each of at least two of the cable connection panels is configured to couple at least one external cable having a different end configuration than at least one other of the cable connection panels.

20. A method of providing power to electrical systems, comprising:

selecting, from among two or more cable connection panels, a cable connection panel to be installed on a chassis assembly for each of one or more electrical systems, wherein each of at least two of the cable connection panels is configured to couple at least one external cable having a different end configuration than at least one other of the cable connection panels; and for at least one of the electrical systems:

coupling the selected cable connection panel to the chassis assembly; and electrically coupling at least one cable at least partially supported by the cable connection panel to one or more chassis connectors coupled to the chassis assembly, wherein the at least one electrical system comprises an automatic transfer switch, the method further comprising automatically switching power between two or more power inputs carried through the cable connection panel.

21. The method of claim 20, wherein the one or more electrical systems comprise two or more automatic transfer switches in a data center, wherein the cable connection panel for at least one of the automatic transfer switches in the data center supports a cable having a different end configuration than the cable for at least one other of the automatic transfer switches in the data center.

22. The method of claim 20, wherein electrically coupling the at least one cable to the one or more chassis connectors comprises:

feeding a portion of at least one cable through at least one opening in the selected cable connection panel; and coupling at least one conductor of the at least one cable to at least one of the chassis connectors.

23. The method of claim 20, further comprising, for the at least one electrical system:

before coupling the selected cable connection panel to the chassis assembly, removing a cable connection panel from the chassis assembly, wherein the removed cable connection panel is configured to couple an external cable having a different end configuration than selected cable connection panel.

24. A method of providing power to electrical systems, comprising:

selecting, from among two or more cable connection panels, a cable connection panel to be installed on a chassis assembly for each of one or more electrical systems, wherein each of at least two of the cable connection panels is configured to couple at least one external cable having a different end configuration than at least one other of the cable connection panels; and for at least one of the electrical systems:

coupling the selected cable connection panel to the chassis assembly; and electrically coupling at least one cable at least partially supported by the cable connection panel to one or more chassis connectors coupled to the chassis assembly, wherein the selected cable connection panel comprises one or more panel receptacles, wherein electrically coupling the at least one cable to the one or more chassis connectors comprises:

coupling one or more electrical contacts in the panel receptacle with one or more electrical contacts of at least one of the chassis connectors; and installing one or more connector plugs in at least one of the panel receptacles.

* * * * *